US010433684B1

(12) United States Patent
Cen

(10) Patent No.: US 10,433,684 B1
(45) Date of Patent: Oct. 8, 2019

(54) SEAT CUSHION PAPER DEVICE, TOILET COVER, AND TOILET

(71) Applicant: Shenzhen Chuangyuanteng Technology Co., Ltd., Shenzhen (CN)

(72) Inventor: Dehua Cen, Guizhou (CN)

(73) Assignee: Shenzhen Chuangyuanteng Technology Co., Ltd., Shenzhen (CN)

( * ) Notice: Subject to any disclaimer, the term of this patent is extended or adjusted under 35 U.S.C. 154(b) by 0 days.

(21) Appl. No.: 16/305,400

(22) PCT Filed: Jun. 2, 2017

(86) PCT No.: PCT/CN2017/087075
§ 371 (c)(1),
(2) Date: Nov. 29, 2018

(87) PCT Pub. No.: WO2017/211239
PCT Pub. Date: Dec. 14, 2017

(30) Foreign Application Priority Data

Jun. 7, 2016 (CN) ..... 2016 2 0547359 U

(51) Int. Cl.
*A47K 13/22* (2006.01)

(52) U.S. Cl.
CPC ..... *A47K 13/22* (2013.01)

(58) Field of Classification Search
CPC ..... A47K 13/22; A47K 13/00; A47K 13/02; A47K 13/04
See application file for complete search history.

(56) References Cited

U.S. PATENT DOCUMENTS 4,944,046 A 7/1990 Huh et al.

FOREIGN PATENT DOCUMENTS

CN 2443693 Y 8/2001
CN 1312047 A 9/2001
(Continued)

OTHER PUBLICATIONS

Qiuxiang Xu, the International Searching Authority written comments, Aug. 2017, CN.
(Continued)

*Primary Examiner* — Christine J Skubinna

(57) ABSTRACT

A seat cushion paper device (230) includes an receiving box (233), multiple pieces of folded seat cushion paper (231), and multiple mounting members (232). Each piece of seat cushion paper (231) includes a first end (2311), a second end (2312), and a fixing portion (2314). The first ends (2311) of the pieces of seat cushion paper (231) are sequentially accommodated at a bottom end (2332) of the receiving box (233), the fixing portion (2314) of the pieces of seat cushion paper (231) are sequentially fixed to a top end (2331) of the receiving box (233), and each of the second ends (2312) of the pieces of seat cushion paper (231) is provided with a mounting portion (332). In addition, also provided is a toilet. The toilet comprises a toilet body (100) and a toilet cover (200). The toilet cover (200) is movably mounted on the toilet body (100). The toilet cover (200) comprises a cover plate (210), a seat cushion ring (220), the seat cushion paper device (230), and the accommodating room (240). The accommodating room (240) is mounted on the cover plate (210). The seat cushion paper device (230) is accommodated in the accommodating room (240). By means of the design of the receiving box (233) and the fixing portions (2314) of the seat cushion paper (231), the pieces of the seat cushion paper (231) do not topple over due to the gravity effect of the pieces of the seat cushion paper (231) when the toilet cover plate (210) is erected, and accordingly all the pieces of the seat cushion paper (231) in the seat cushion paper device (230) are prevented from being mixed together, thereby allowing the toilet to be conveniently used.

10 Claims, 7 Drawing Sheets

(56) References Cited

FOREIGN PATENT DOCUMENTS

| | | | |
|---|---|---|---|
| CN | 201232240 | Y | 5/2009 |
| CN | 105054858 | A | 11/2015 |
| GB | 193514 | A | 2/1923 |
| JP | H11309087 | A | 11/1999 |
| JP | 2008200462 | A | 9/2008 |

OTHER PUBLICATIONS

International Search Report for PCTICN2017/087075.
International Publication for PCT/CN2017/087075.

SEAT CUSHION PAPER DEVICE, TOILET COVER, AND TOILET

BACKGROUND

1. Technical Field

The present invention relates to sanitary equipments, in particular to relates to a seat cushion paper device, a toilet cover, and a toilet.

2. Description of Related Art

Disposable seat cushion paper is now well popularized in public. It can prevent people from touching a seat cushion ring directly, thus preventing cross infection of some infectious diseases. And the seat cushion paper is usually placed beside the toilet by a loading box, and people need to pull it off and then put in on the seat cushion ring during using, which is not only troublesome, but also makes the seat cushion paper take up some space of the bathroom to make the bathroom narrower.

Now there are some patents in China about mounting the seat cushion paper to the toilet, but the seat cushion paper cannot be well fixed. When a cover plate of the toilet cover is open, the seat cushion paper often falls down under the action of gravity, causing all the seat cushion paper to mess together to make the seat cushion paper to unavailable.

SUMMARY

In order to solve the above problems, the present invention provides a seat cushion paper device which can solve the problem that all seat cushion papers are scrambled together when seat cushion paper is poured downward under the action of its own gravity, and a toilet cover and toilet are included therein.

The technical solution adopted for solving technical problems of the present disclosure is:

A seat cushion paper device includes: an receiving box comprising a bottom end and a top end; a plurality of folded seat cushion paper received in the receiving box, each of the seat cushion paper including a first end, a second end opposite to the first end, and a fixing member positioned in a middle portion thereof and discontinuously connected with other portions thereof, the first ends sequentially fixed to the bottom end of the receiving box, the second ends sequentially fixed to the top end of the receiving box; and a plurality of mounting members received in the receiving box, each of the mounting members mounted to a corresponding second end.

Wherein when the seat cushion paper is folded, a left portion of the seat cushion paper and a right portion of the seat cushion paper is folded to the middle portion of the seat cushion paper and the seat cushion paper is folded up and down, after the seat cushion paper is folded, the second ends of the seat cushion paper are adjacent to the bottom end of the receiving box, the mounting members are adjacent to a center of the top end of the receiving box.

Wherein the seat cushion paper includes a paper body located between the first end and the second end, and the paper body is discontinuously connected with the first end.

Wherein the paper body includes a contacting member, an insulating member, and the fixing member discontinuously connected with the insulating member, the contacting member touches a seat cushion ring of a toilet cover, the insulating member is corresponding to a cavity of the seat cushion ring and is discontinuously connected with the contacting member.

Wherein the receiving box includes a first opening adjacent to the bottom end thereof and a first closing cover to cover the first opening.

Wherein the receiving box includes a first opening adjacent to the bottom end thereof and a zipper to cover the first opening.

Wherein the receiving box includes a first opening adjacent to the bottom end thereof and a velcro to cover the first opening.

A toilet cover includes a cover plate; a seat cushion ring movably mounted to the cover plate; n accommodating room mounted to the cover plate, the accommodating room comprises an accommodating space; and the aforementioned seat cushion paper device received in the accommodating space. The accommodating room includes a second opening adjacent to a connection between the cover plate and the seat cushion ring and corresponding to the first opening, and a second closing cover movably mounted to the accommodating room to open or close the second opening. The second end of each of the seat cushion paper is pulled out of the receiving box through the first opening and the second opening, and is fixed on the seat cushion ring by a corresponding mounting member.

Wherein the accommodating room comprises a pair of sliding rails positioning two opposite sides thereof, and the second closing cover slides along the sliding rails to open or close the second opening.

Wherein the seat cushion ring comprises a connecting end movably connected with the cover plate, a free end, a first receiving groove adjacent to the connecting end, and a second receiving groove adjacent to the free end and in communication with the first receiving groove.

Wherein the first receiving groove is square, and the second receiving groove is circular.

A toilet includes a toilet body; and the aforementioned toilet cover movably mounted on the toilet body The present disclosure provides the advantages as below.

The present invention fixes the first end of a plurality of folded seat cushion paper at the bottom end of the receiving box in turn and the fixing member of each seat cushion paper at the a top end of the receiving box in turn by the design of the receiving box, that is to say, the first end and the fixing member of the seat cushion paper are fixed at both ends of the receiving box, so that the seat cushion paper cannot falls down under the action of gravity to prevent all the seat cushion paper from messing together to conveniently use the toilet. Furthermore, when the second end is pull out of the receiving box, the first ends can support the seat cushion paper because the first ends are sequentially fixed to the bottom end of the receiving box, so that the seat cushion paper is conveniently rolled out and located in the toilet.

In the seat cushion paper device of the present invention, the folding of the seat cushion paper is left-right to middle folding and up-and-down folding. After the seat cushion paper is folded, the second ends of the seat cushion paper are adjacent to the bottom end of the receiving box, which makes the seat cushion paper easy to pull out and expand when used. At the same time, each of the mounting members is mounted to a corresponding second end of the seat cushion paper, so that the seat cushion paper can be conveniently fixed on the seat cushion ring. Therefore, the design of the seat cushion paper device makes the toilet in this scheme more convenient to use and operate.

Each of the mounting members is mounted to the corresponding second end of seat cushion paper of the seat cushion paper device of the present invention, that is to say, the mounting members are disposable. Therefore, it is not necessary to install an adsorption structure on the seat cushion ring, which avoids the stickiness of the adsorption structure affected by unclean things, that is, the troublesome daily maintenance is avoided.

BRIEF DESCRIPTION OF THE DRAWINGS

Many aspects of the embodiments can be better understood with reference to the following drawings. The components in the drawings are not necessarily dawns to scale, the emphasis instead being placed upon clearly illustrating the principles of the embodiments. Moreover, in the drawings, like reference numerals designate corresponding parts throughout the several views.

DETAILED DESCRIPTION

In order to more clearly and completely explain the technical proposal of the invention, many aspects of the embodiments can be better understood with reference to the following drawings.

Figure 1:
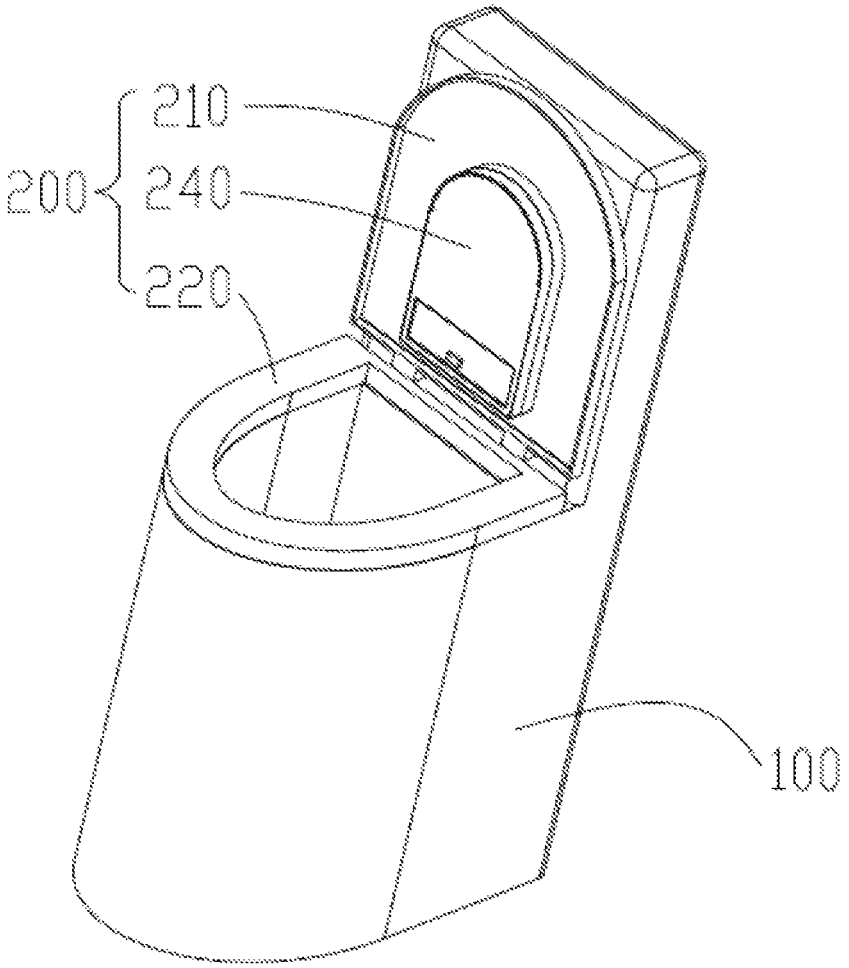
FIG. 1 is an isometric view of a toilet of an exemplary embodiment of the present invention.

Referring to FIG. 1, the toilet in accordance with an exemplary embodiment of the present disclosure includes a toilet body 100 and a toilet cover 200 movably mounted on the toilet body 100.

Figure 2:
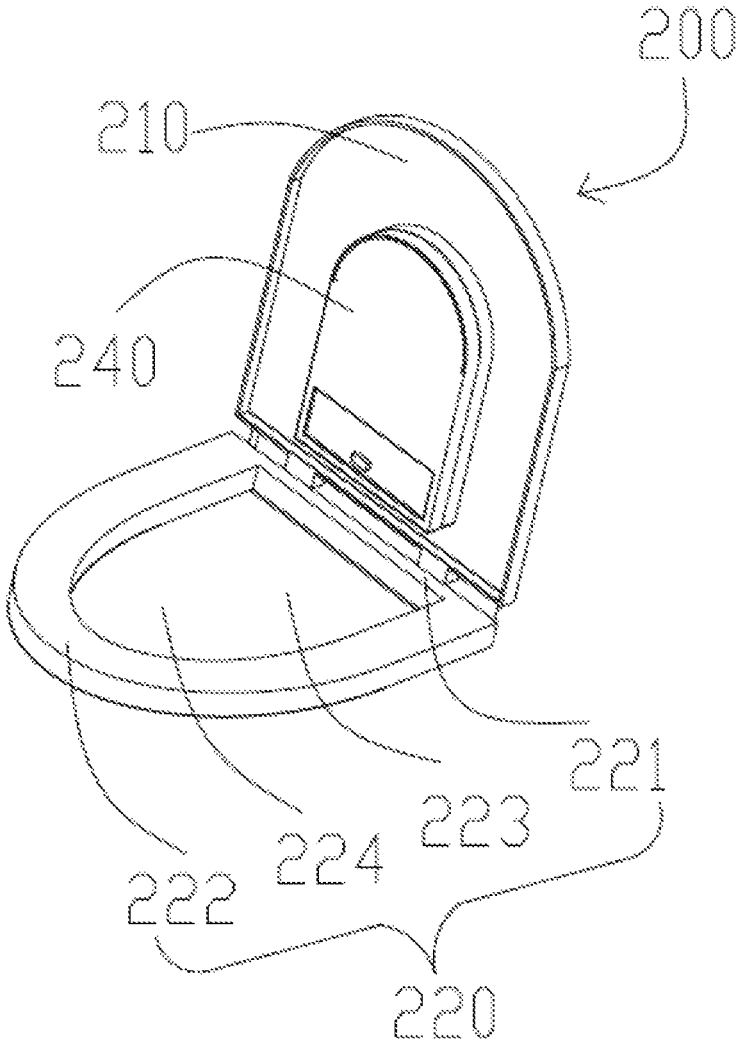
FIG. 2 is an isometric view of a toilet cover of FIG. 1.
Figure 3:
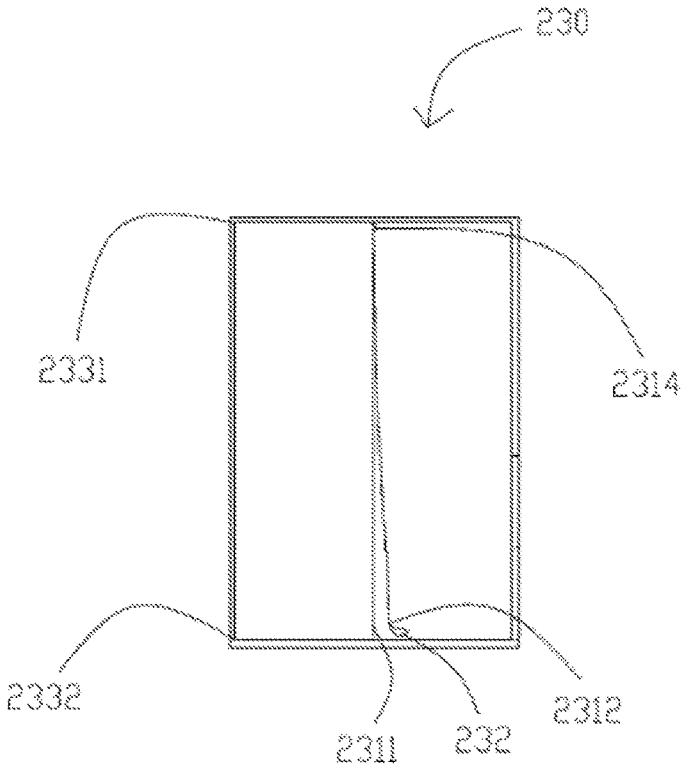
FIG. 3 is a schematic diagram of a seat cushion paper device of FIG. 1.

Referring to FIG. 2 and FIG. 3, the toilet cover 200 includes a cover plate 210, a seat cushion ring 220 movably mounted to the cover plate 210, a seat cushion paper device 230, and an accommodating room 240 mounted to the cover plate 210. The seat cushion paper device 230 is received in the accommodating room 240.

Figure 4:
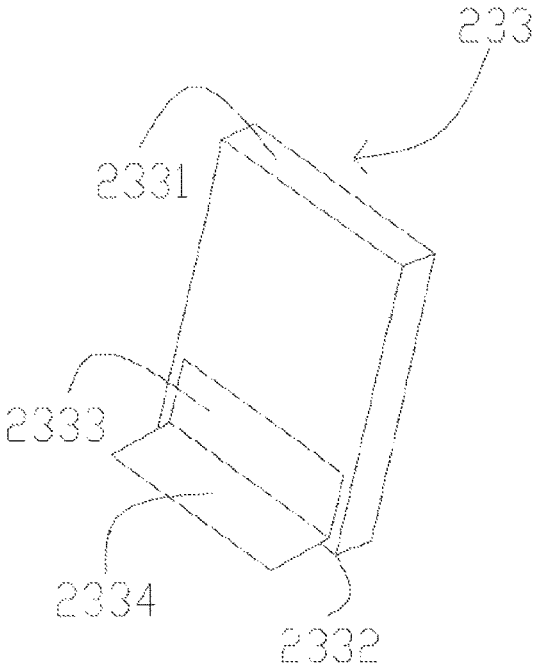
FIG. 4 is a schematic diagram of receiving box in accordance with a first embodiment of FIG. 1.
Figure 5:
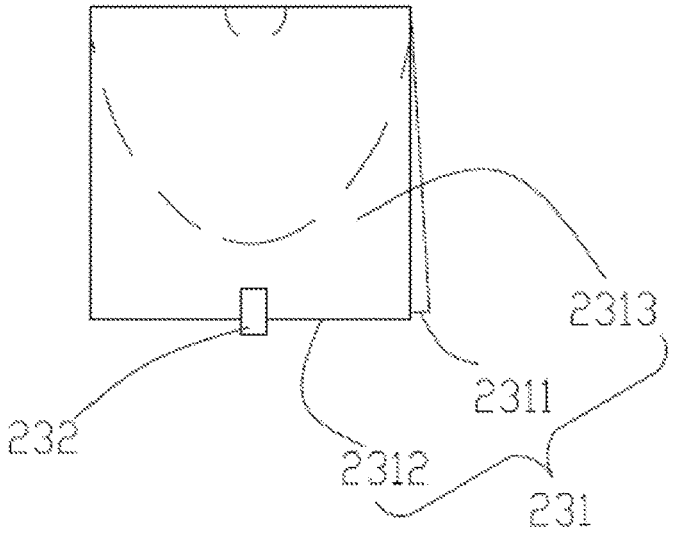
FIG. 5 is a schematic diagram of a seat cushion paper in a folded state of FIG. 1.

Referring to FIG. 3, FIG. 4 and FIG. 5, the seat cushion paper device 230 includes an receiving box 233, a plurality of folded seat cushion paper 231 received in the receiving box 233 and a plurality of mounting members 232 received in the receiving box 233. Each of the seat cushion paper 231 includes a first end 2311, a second end 2312 opposite to the first end 2311, and a fixing member 2314 positioned in a middle portion thereof and discontinuously connected with other portions thereof. The first ends 2311 are sequentially fixed to a bottom end 2332 of the receiving box 233, and the fixing members 2314 are sequentially fixed to a top end 2331 of the receiving box 233. Each of the mounting members 232 is mounted to a corresponding second end 2312.

In one embodiment, the seat cushion paper 231 is water-soluble paper, which can directly go to the toilet without blocking the toilet. After the seat cushion paper 231 is folded, the seat cushion paper 231 is received in the receiving box 233, and the first ends 2311 are sequentially fixed to the bottom end 2332 of the receiving box 233, and the fixing members 2314 are sequentially fixed to the top end 2331 of the receiving box 233, that is to say, the first ends 2311 and the fixing members 2314 are sequentially fixed to the receiving box 233 respectively, so that the seat cushion paper 231 cannot falls down under the action of gravity to prevent all the seat cushion paper 231 from messing together to conveniently use the toilet. Furthermore, when the second end 2312 is pull out of the receiving box 233, the first ends 2311 can support the seat cushion paper 231 because the first ends 2311 are sequentially fixed to the bottom end 2332 of the receiving box 233, so that the seat cushion paper 231 is conveniently rolled out and located in the toilet. Simultaneously, each of the mounting members 232 is mounted to the corresponding second end 2312, that is to say, the mounting members 232 are disposable. Therefore, it is not necessary to install an adsorption structure on the seat cushion ring 220, which avoids the stickiness of the adsorption structure affected by unclean things, that is, the troublesome daily maintenance is avoided.

In the embodiment, each of the mounting members 232 has good adhesion, each of the mounting members 232 is directly pasted on the seat cushion ring 220 during the seat cushion paper 231 being used, so that the seat cushion paper 231 does not move during using, thereby improving the comfort of use. Furthermore, the mounting members 232 are self-adhesive.

Furthermore, referring to FIG. 5, when the seat cushion paper 231 is folded, a left portion of the seat cushion paper 231 and a right portion of the seat cushion paper 231 is folded to the middle portion of the seat cushion paper 231 and the seat cushion paper 231 is folded up and down, after the seat cushion paper 231 is folded, the second ends 2312 of the seat cushion paper 231 are adjacent to the bottom end 2332 of the receiving box 233, the mounting members 2314 are adjacent to a center of the top end 2331 of the receiving box 233. The seat cushion paper 231 is conveniently pulled out of the accommodating room 240 because of the second ends 2312 of the seat cushion paper 231 adjacent to the bottom end 2332. In addition, the mounting members 2314 are mounted to the top end 2331 of the receiving box 233, thereby prevent the seat cushion paper 231 from falling down under its own gravity.

Figure 6:
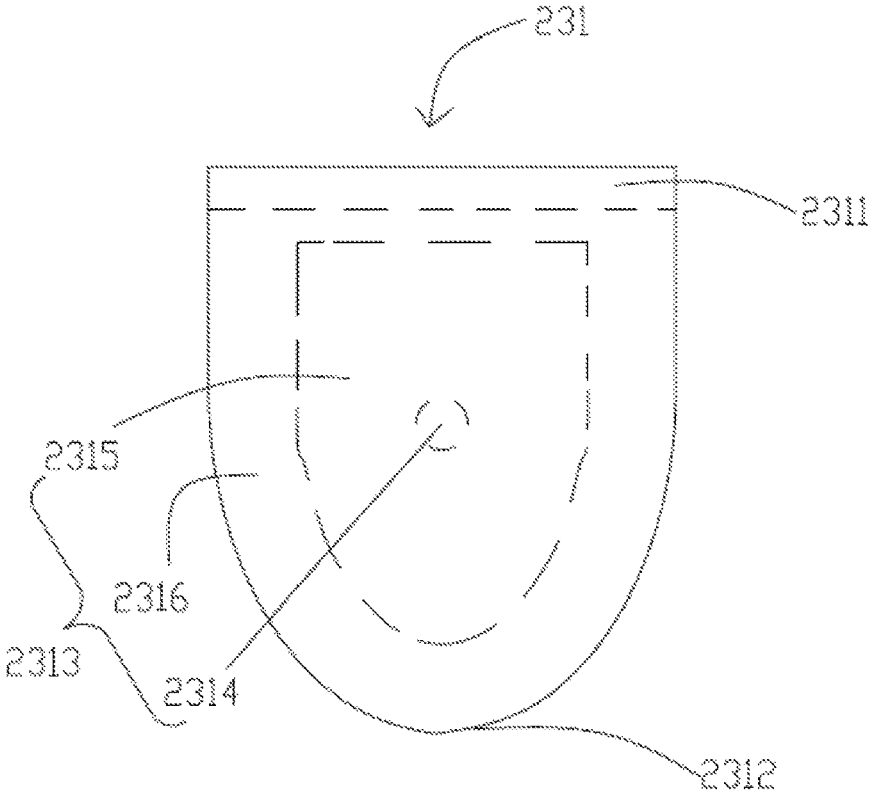
FIG. 6 is a schematic diagram of the seat cushion paper in an open state of FIG. 1.

Referring to FIG. 5 and FIG. 6, the seat cushion paper 231 includes a paper body 2313 located between the first end 2311 and the second end 2312, and the paper body 2313 is discontinuously connected with the first end 2311, so that, after using the cushion paper 231, users can easily separate the paper body 2313 from the first end 2311 of the seat cushion paper 231.

Referring to FIG. 6, the paper body 2313 includes a contacting member 2316, an insulating member 2315. The contacting member 2316 touches the seat cushion ring 220, and the insulating member 2315 is corresponding to a cavity of the seat cushion ring 220 and is discontinuously connected with the contacting member 2316. The contacting member 2316 makes the user not directly contact with the seat cushion ring 220, and the insulating member 2315 can prevent the water in the toilet from splashing to the user's body, and further guarantees the use of health.

Referring to FIG. 4, the receiving box 233 includes a first opening 2333 adjacent to the bottom end 2332 thereof and a first closing cover 2334 to cover the first opening 2333. In the embodiment, receiving box 233 is made of cardboard, and walls of the first opening 2333 and the first closing cover 2334 are connected by saw tooth lines, during use, the first closing cover 2334 can be opened easily along the saw tooth lines.

In the embodiment, each of the first ends 2311 of the seat cushion paper 231 is fixed in the bottom end 2332 of the receiving box 233, and each of the fixing members 2314 is fixed in the top end 2331 of the receiving box 233.

In the embodiment, the first ends 2311 and the fixing members 2314 are fixed by glue.

In other embodiments, the first ends 2311 and the fixing members 2314 are fixed by crews, rivets, studs, and staples. In addition, the first ends 2311 and the fixing members 2314 are fixed by lines.

Figure 7:
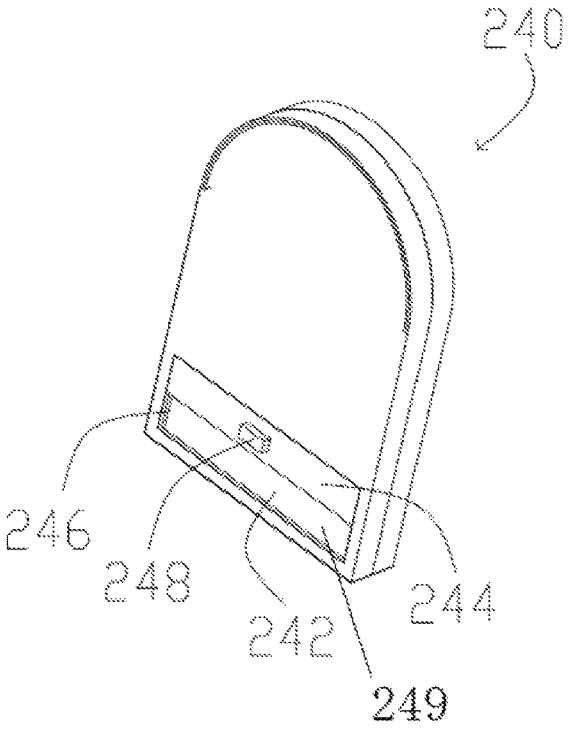
FIG. 7 is an isometric view of an accommodating room of FIG. 1.
Figure 8:
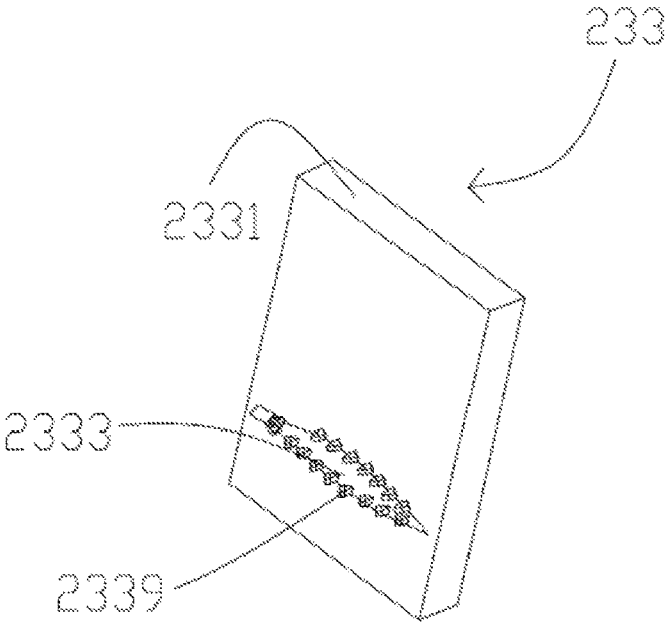
FIG. 8 is a schematic diagram of receiving box in accordance with a second embodiment of FIG. 1.

Referring to FIG. 2 and FIG. 7, the accommodating room 240 is mounted to the cover plate 210. The accommodating room 240 includes an accommodating space 249 to receive the seat cushion paper device 230. The accommodating room 240 includes a second opening 242 adjacent to a connection between the cover plate 210 and the seat cushion ring 220 and corresponding to the first opening 2333, and a second closing cover 244 movably mounted to the accommodating room 240 to open or close the second opening 242. The second end 2312 of each of the seat cushion paper 231 is pulled out of the receiving box 233 through the first opening 2333 and the second opening 242, and is fixed on the seat cushion ring 220 by a corresponding mounting member 232.

In one embodiment, the second closing cover 244 is a sliding door.

Because the accommodating room 240 includes the accommodating space 249 to receive the seat cushion paper device 230, a new seat cushion paper device 230 is put into the accommodating space 249 when the seat cushion paper device 230 need to be replaced to facilitate replace the seat cushion paper device 230. Because the second opening 242 adjacent to the connection between the cover plate 210 and the seat cushion ring 220 and corresponding to the first opening 2333, the second end 2312 of each of the seat cushion paper 231 is pulled out of the receiving box 233 through the first opening 2333 and the second opening 242, and is fixed on the seat cushion ring 220 by the corresponding mounting member 232. Furthermore, the second closing cover is the sliding door, thereby ensuring the dry hygiene of the seat cushion paper 231 inside the accommodating room 240. The second closing cover 244 can close the second opening 242, that is to say, the accommodating room 240 is sealed, so that the east cushion paper 231 does not be dampened or infected with germs. In addition, the accommodating room 240 is mounted to the cover plate 210, thereby saving space.

Referring to FIG. 7, the accommodating room 240 includes a pair of sliding rails 246 positioning two opposite sides thereof, and the second closing cover 244 slides along the sliding rails 246 to open or close the second opening 242. The second closing cover 244 is in clearance fit with the sliding rails 246 respectively. The second closing cover 244 includes a handle 248. When the user uses the seat cushion paper 231, the second closing cover 244 slides along the sliding rails 246 by the handle 248 pushing the second closing cover 244 to open the second opening 242, the second closing cover 244 automatically slides down along the sliding rails 246 by its own gravity and closes the second opening 242, after the user takes the seat cushion paper 231.

Referring to FIG. 2, the seat cushion ring 220 includes a connecting end 221 movably connected with the cover plate 210, a free end 222, a square first receiving groove 223 adjacent to the connecting end 221, and a circular second receiving groove 224 adjacent to the free end 222 and in communication with the first receiving groove 223. When the cover plate 210 and the seat cushion ring 220 are closed mutually, the internal interference between the accommodating room 240 and the seat cushion ring 220 can be avoided.

In assembly of the seat cushion paper device 230 of the present disclosure In assembly, first end 2311 of the seat cushion paper 231 are sequentially fixed to the bottom end 2332 of the receiving box 233 by glue, the fixing members 2314 are sequentially fixed to the top end 2331 of the receiving box 233 by glue, then the receiving box 233 is sealed and the seat cushion paper device 230 is installed in the accommodating space 249 of the accommodating room 240. In use, the first opening 2333 is open by tearing the first closing cover 2334 along the saw tooth lines, and the second closing cover 244 is pushed to open the second opening 242, the mounting members 232 is pulled out through the first opening 2333 and second opening 242, the seat cushion paper 231 is spread and fixed to the seat cushion ring 220 by the mounting members 232 and the insulating member 2315 is disengaged from the contacting member 2316, the user can use the toilet. After use, the user can easily separate the seat cushion paper 231 from the bottom end 2332 of the receiving box 233, and the seat cushion paper 231 is put directly into the toilet and directly dissolved in water, thus the user can safely use the toilet without worrying about the cleanliness and hygiene, and prevents the spread of the disease, thereby solving the problem of dirty and unhygienic caused by different users directly contacting the same seat cushion ring 220 in the prior art.

In other embodiment, the toilet cover 200 includes a cover plate 210, a seat cushion ring 220 movably mounted to the cover plate 210, a seat cushion paper device 230, but not includes an accommodating room 240. That is to say, the seat cushion paper device 230 is directly fixed onto an inner face of the cover plate 210, namely, the seat cushion paper device 230 is fixed onto the inner face of the cover plate 210 by double faced adhesive tape, sucker, or glue.

In other embodiment, the receiving box 233 is made of moisture proof cloth. A zipper 2339 is arranged to seal to the first opening 2333. In use, the zipper 2339 is open, and the seat cushion paper 231 is taken out through the first opening 2333. After use, the zipper 2339 is closed to seal the first opening 2333 to prevent damp or pollution of the seat cushion paper 231.

Figure 9:
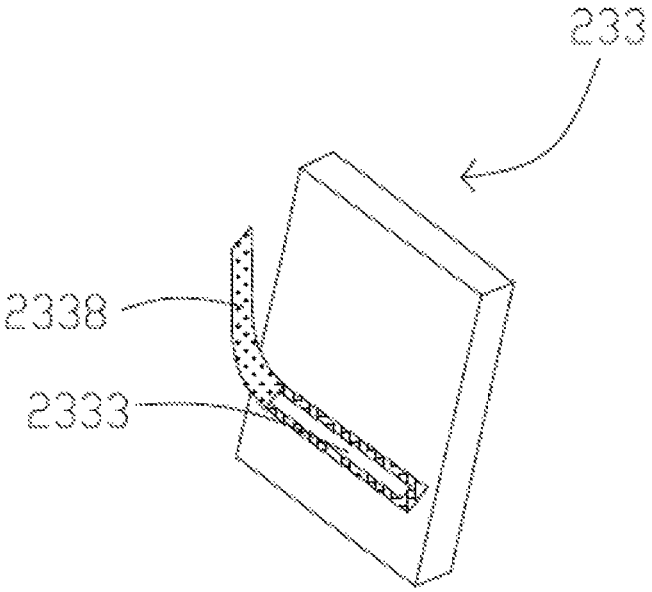
FIG. 9 is a schematic diagram of receiving box in accordance with a third embodiment of FIG. 1.

Referring to FIG. 9, a velcro 2338 is arranged to seal the first opening 2333. In use, the velcro 2338 is open, and the seat cushion paper 231 is taken out through the first opening 2333. After use, the velcro 2338 is closed to seal the first opening 2333 to prevent damp or pollution of the seat cushion paper 231.

Figure 10:
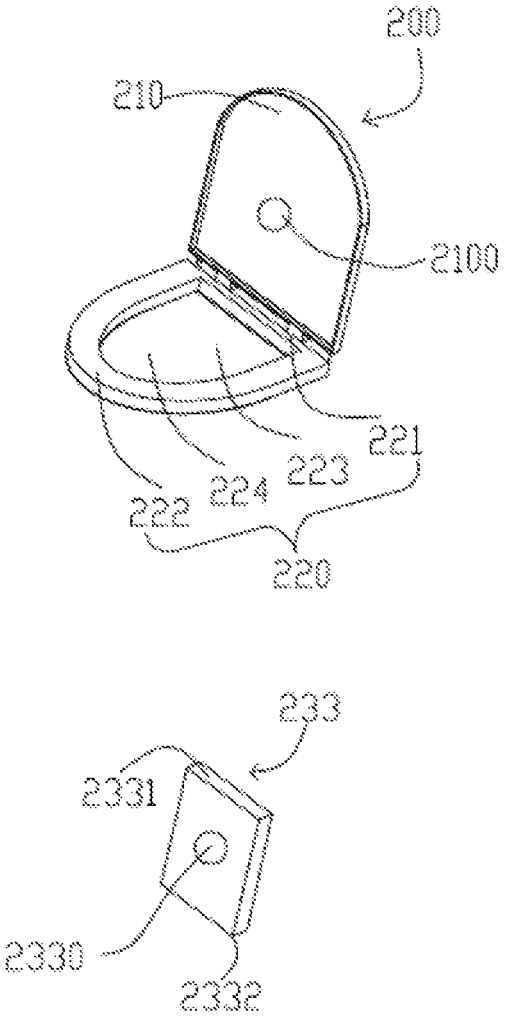
FIG. 10 is an exploded isometric view of a toilet cover and a receiving box in accordance with a second embodiment of the present invention.

Referring to FIG. 10, the receiving box 233 includes a first magnetic element 2330 arranged in a back face thereof opposite to the first opening 2333, and the cover plate 210 includes a second magnetic element 2100 arranged in an inner thereof. The receiving box 233 is mounted to the cover plate 210 through the first magnetic element 2330 and the second magnetic element 2100. In detail, the first magnetic element 2330 is a magnetic metal, and the second magnetic element 2100 is a magnet, or the first magnetic element 2330 is a magnet, and the second magnetic element 2100 is a magnetic metal.

What is claimed is:

1. A seat cushion paper device, comprising:

an receiving box comprising a bottom end and a top end;

a plurality of folded seat cushion paper received in the receiving box, each of the seat cushion paper comprising a first end, a second end opposite to the first end, and a fixing member positioned in a middle portion thereof and discontinuously connected with other portions thereof, the first ends sequentially fixed to the bottom end of the receiving box, the second ends sequentially fixed to the top end of the receiving box; and a plurality of mounting members received in the receiving box, each of the mounting members mounted to a corresponding second end.

2. The seat cushion paper device as claimed in claim 1, wherein when the seat cushion paper is folded, a left portion of the seat cushion paper and a right portion of the seat cushion paper is folded to the middle portion of the seat cushion paper and the seat cushion paper is folded up and down, after the seat cushion paper is folded, the second ends of the seat cushion paper are adjacent to the bottom end of the receiving box, the mounting members are adjacent to a center of the top end of the receiving box.

3. The seat cushion paper device as claimed in claim 1, wherein the seat cushion paper comprises a paper body located between the first end and the second end, and the paper body is discontinuously connected with the first end.

4. The seat cushion paper device as claimed in claim 3, wherein the paper body comprises a contacting member, an insulating member, and the fixing member discontinuously connected with the insulating member, the contacting member touches a seat cushion ring of a toilet cover, the insulating member is corresponding to a cavity of the seat cushion ring and is discontinuously connected with the contacting member.

5. The seat cushion paper device as claimed in claim 1, wherein the receiving box comprises a first opening adjacent to the bottom end thereof and a first closing cover to cover the first opening.

6. The seat cushion paper device as claimed in claim 1, wherein the receiving box comprises a first opening adjacent to the bottom end thereof and a zipper to cover the first opening.

7. The seat cushion paper device as claimed in claim 1, wherein the receiving box comprises a first opening adjacent to the bottom end thereof and a velcro to cover the first opening.

8. A toilet cover, comprising:

a cover plate;

a seat cushion ring movably mounted to the cover plate;

an accommodating room mounted to the cover plate, the accommodating room comprises an accommodating space; and a seat cushion paper device received in the accommodating space, the seat cushion paper device comprising:

an receiving box comprising a bottom end, a top end, a first opening adjacent to the bottom end thereof and a first closing cover to cover the first opening;

a plurality of folded seat cushion paper received in the receiving box, each of the seat cushion paper comprising a first end, a second end opposite to the first end, and a fixing member positioned in a middle portion thereof and discontinuously connected with other portions thereof, the first ends sequentially fixed to the bottom end of the receiving box, the second ends sequentially fixed to the top end of the receiving box; and a plurality of mounting members received in the receiving box, each of the mounting members mounted to a corresponding second end;

wherein the accommodating room comprises a second opening adjacent to a connection between the cover plate and the seat cushion ring and corresponding to the first opening, and a second closing cover movably mounted to the accommodating room to open or close the second opening, and wherein the second end of each of the seat cushion paper is pulled out of the receiving box through the first opening and the second opening, and is fixed on the seat cushion ring by a corresponding mounting member.

9. The toilet cover as claimed in claim 8, wherein the accommodating room comprises a pair of sliding rails positioning two opposite sides thereof, and the second closing cover slides along the sliding rails to open or close the second opening.

10. A toilet, comprising:

a toilet body; and a toilet cover movably mounted on the toilet body, the toilet cover comprising:

a cover plate;

a seat cushion ring movably mounted to the cover plate; and a seat cushion paper device mounted to the cover plate, the seat cushion paper device comprising:

an receiving box comprising a bottom end, and a top end;

a plurality of folded seat cushion paper received in the receiving box, each of the seat cushion paper comprising a first end, a second end opposite to the first end, and a fixing member positioned in a middle portion thereof and discontinuously connected with other portions thereof, the first ends sequentially fixed to the bottom end of the receiving box, the second ends sequentially fixed to the top end of the receiving box; and a plurality of mounting members received in the receiving box, each of the mounting members mounted to a corresponding second end.

* * * * *